United States Patent [19]

Cunningham

[11] 4,121,712

[45] Oct. 24, 1978

[54] PLASTIC SHEET BAND MULTI-PACKAGING DEVICE AND METHOD OF ASSEMBLING SAME TO CONTAINERS

[75] Inventor: Ernest Ray Cunningham, Libertyville, Ill.

[73] Assignee: Grip-Pak Systems, Inc., Cape Girardeau, Mo.

[21] Appl. No.: 845,895

[22] Filed: Oct. 27, 1977

[51] Int. Cl.[2] ..... B65D 75/00; B65D 85/62

[52] U.S. Cl. ..... 206/150; 206/158; 206/161; 53/398; 294/87.2

[58] Field of Search ..... 206/150, 158, 161, 145, 206/153; 294/87.2; 53/26

[56] References Cited

U.S. PATENT DOCUMENTS

| | | | |
|---|---|---|---|
| 3,302,784 | 2/1967 | Copping | 206/153 |
| 3,874,502 | 4/1975 | Weaver | 206/150 |

*Primary Examiner*—William T. Dixson, Jr.
*Attorney, Agent, or Firm*—Michael Kovac

[57] ABSTRACT

A plastic sheet band multi-packaging device is disclosed as having means to facilitate carrying thereof in an economical and efficient multi-packaging design. The assembly of plastic sheet band multi-packaging devices to containers can also be greatly enhanced by folding techniques prior to and/or during assembly.

11 Claims, 6 Drawing Figures

PLASTIC SHEET BAND MULTI-PACKAGING DEVICE AND METHOD OF ASSEMBLING SAME TO CONTAINERS

SUMMARY OF THE INVENTION

Expired U.S. Pat. No. 2,874,835 discloses an apertured plastic sheet carrier device formed from an unsupported sheet of resilient, elastic and deformable material such as low density polyethylene. Each aperture of the carrier device has a maximum transverse diameter less than the diameter of containers to be associated therewith such that when the apertures are stretched and axially inserted over containers, the marginal portions surrounding each aperture are stretched and deformed to form embracing collars for gripping and holding containers.

Apertured plastic sheet carrier devices have been widely and successfully utilized in the packaging of a plurality of containers to form multi-packages such as the 6-pack, 8-pack and other package designs. This success can be attributed to the fact that such devices are not only more economical than other carrier devices which have been able to be marketed to date, but they also readily adapt themselves to high speed assembly equipment within the range, for example, of 500 to 2000 containers per minute.

When apertured plastic sheet carrier devices were first used commercially, separate injection molded handles, as shown for example in U.S. Pat. No. 3,016,136, were used for carrying the container package. Further, integral upstanding handles, as disclosed in U.S. Pat. Nos. 3,268,070 and 3,269,530, were incorporated in the apertured plastic sheet carrier; however, the cost of such separate and integral handles gave way to the "bowling grip" carrier style first disclosed in FIG. 27 of expired U.S. Pat. No. 2,874,835, with the first commercial design shown, for example, in U.S. Pat. No. 3,374,028.

Continuing developments of "bowling grip" style apertured plastic sheet carrier devices have produced several new designs which provide "bowling grip" style carriers with use of less material and/or uniform spacing to permit separation of containers into groups of two, four, six, eight, etc. Examples of these new designs are shown in U.S. Pat. Nos. 3,778,096; 3,733,100 and 3,874,502.

The present invention is still another form of apertured plastic sheet carrier device that provides efficient utilization of material together with a novel form of "bowling grip" carrying means.

In addition, the present invention is directed to a novel method of applying apertured plastic sheet carrier devices to containers. In expired U.S. Pat. No. 2,929,181, apertured plastic sheet carriers are applied to containers by stretching the apertures of the carrier device and then moving the carriers and containers in telescopic relationship. For continuous high speed application of carriers to containers, reference is made to the rotary drum with expanding shoes technique shown in U.S. Pat. Nos. 3,032,943 and 3,032,944; the continuous depressing of a central portion of the carrier between rows of containers while simultaneously expanding the apertures of the carrier to assemble the carrier to the containers along a linear path as shown in U.S. Pat. No. 3,383,828; the application of carriers to containers by carrier applicating mechanisms mounted for movement is closed paths and being operated at predetermined faster speeds than containers as disclosed in U.S. Pat. No. 3,906,704; the rotary drum with expanding shoe technique that further includes carrier folding mechanisms as disclosed in U.S. Pat. Nos. 3,715,935 and 3,816,968; and the triangular path assembly machine with the opportunity for bi-directional assembly to containers as shown in U.S. Patent No. (U.S. Ser. No. 771,565 filed Feb. 2, 1977).

While all of the aforementioned techniques can successfully apply carriers to containers at high speeds, they require, in some instances, certain machine elements for assembly, and in other instances, require certain styles of carrier devices. The method of the present invention, while requiring specific steps and carrier styles in order to follow the novel procedural steps herein disclosed, does not restrict the preferred carrier style to be applied only by the herein disclosed method, but enables the carrier to be applied by any of the foregoing techniques, as will become apparent.

Accordingly, it is an object of the present invention to provide an apertured plastic sheet carrier device with a new and improved form of "bowling grip" style for lifting and transporting containers assembled to the carrier device.

Another object of the present invention is to provide a new and improved method for assembling apertured plastic sheet carrier devices to containers.

These and other objects and advantages of the herein disclosed apertured plastic sheet carrier device and assembly method will become more apparent from the ensuing discussion.

DESCRIPTION OF THE PREFERRED EMODIMENTS

It is to be understood in the description that is to follow that the term "stretchable and elastic plastic sheet multi-packaging device" includes resilient, elastic and deformable multi-packaging devices that are formed from plastic material such as low density polyethylene or other equivalent material; the term "container" includes can and bottle products of any shape or size; and the term "package" or "container package" includes a plurality of containers held together by a stretchable and elastic plastic sheet multi-packaging device to form a 6-pack, 8-pack or the like.

Figure 1:
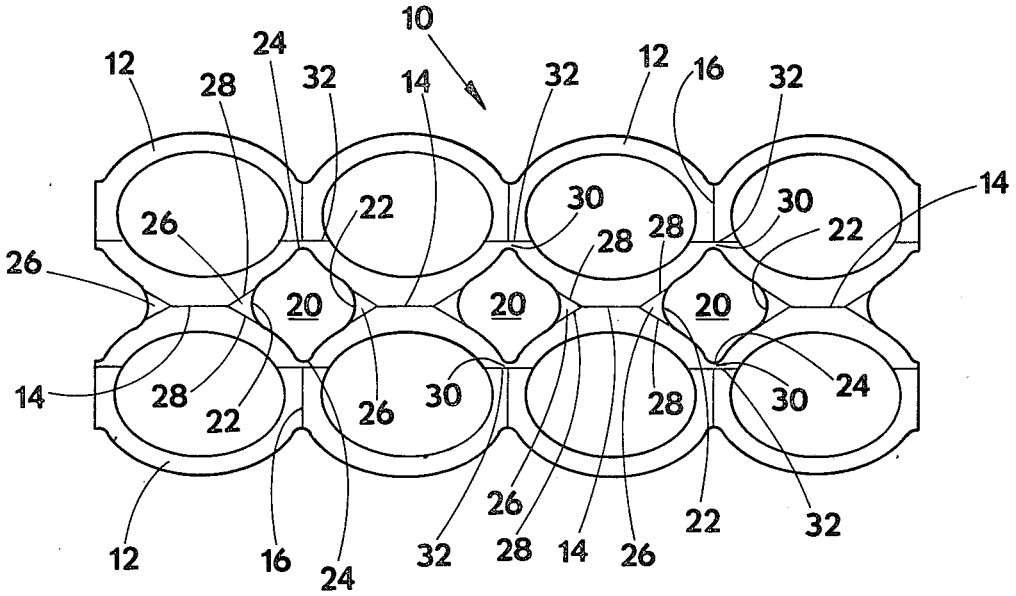
FIG. 1 is a top plan view of an apertured plastic sheet carrier device that is constructed in accordance with the present invention.

The stretchable and elastic plastic sheet multi-packaging device 10 shown in FIG. 1 of the drawings as an 8-pack design includes a plurality of laterally connected pairs of generally ring-like shaped sheet material bands 12 arranged in longitudinal rows with adjacent sheet material bonds 12 in the longitudinal rows being longitudinally connected to one another. The generally ring-like shaped sheet material bands 12 are generally elliptical in configuration with the major axes thereof being longitudinally aligned with adjacent bands 12 in each longitudinal row. The minor axes of adjacent pairs of elliptically shaped bonds 12 in the adjacent longitudinal rows are transversely aligned with one another. This particular multi-package configuration is readily adaptable to various container shapes and sizes such as the fruit juice, beverage and special purpose cans, whether having a cylindrical sidewall or "necked-in" shape below the upper enlarged rim or chime of the cans.

The lateral connections between the sheet material bands 12 in the longitudinal rows are generally identified at 14, while the longitudinal connections between adjacent sheet material bands 12 in each longitudinal row are generally identified at 16. To facilitate assembly of the multi-packaging device 10 and provide a tight cluster arrangement of containers, such as the package of necked-in containers 18 shown in FIG. 2 of the drawings, the lateral connections 14 have a longitudinal fold line or weakened line therein while the longitudinal connections 16 have a lateral fold line and weakened line therein, both of which preferably extend over substantially all or the major part of the length of such connections, except at certain marginal areas as shown and as will be discussed further herein. The fold lines or weakened lines in the lateral and longitudinal connections 14, 16 respectively are impressed in the multi-packaging device 10 during manufacture thereof as impressed grooves which form scored or weakened areas to permit folding along the length thereof. Alternatively, the lateral and longitudinal connections 14, 16 may be perforated or partially scored and partially perforated, to achieve the desired folding.

The area between the lateral and longitudinal connections 14, 16 respectively of two adjacent pairs of sheet material bands 12 defines a generally diamond-shaped opening 20 with rounded concave marginal end portions 22 of the sheet material bands 12 in the vicinity of the lateral connections 14, and rounded concave marginal end portions 24 of the sheet material bands 12 in the vicinity of the longitudinal connections 16.

Figure 2:
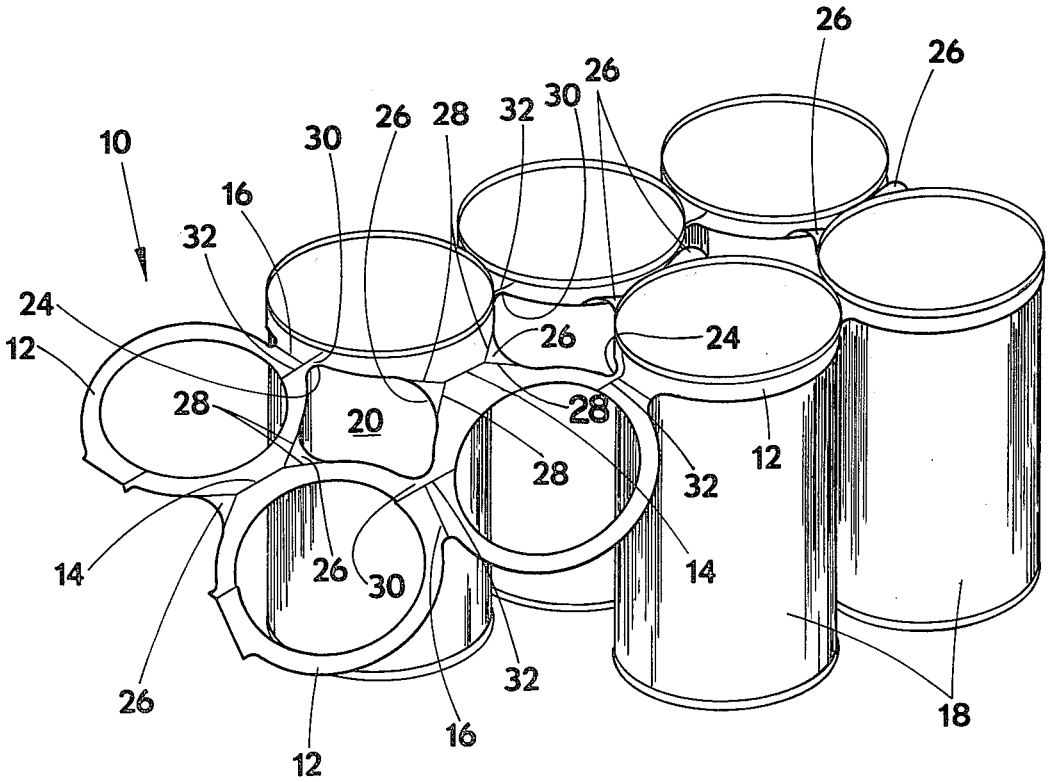
FIG. 2 is a perspective view of the apertured plastic sheet carrier device shown in FIG. 1 as assembled to a plurality of containers to form a container package.

Immediately adjacent portions of the sheet material bands 12 in the vicinity of the lateral connections 14 and rounded concave marginal end portions 22 define central web sections 26. As shown in FIG. 1 and 2 of the drawings, the configuration and size of the central web sections 26 are such as to permit the central web sections 26 to be exposed for gripping on opposite sides of adjacent containers 18 arranged in longitudinal rows when the multi-packaging device 10 is assembled to containers as shown in FIG. 2.

Since the central web sections 26 are relatively small in size, due to economical use of material and efficient carrier design, means are employed to facilitate gripping of the central web sections 26 and lifting or carrying of the package thereby. Specifically, generally V-shaped fold lines or weakened lines 28 are formed or impressed in the central web sections 26 with the V-portion thereof beginning in the vicinity of the longitudinal fold line of the lateral connection 14 at an area spaced from the associated rounded concave marginal end portion 22. The V-shaped fold lines 28 then extend angularly from the longitudinal fold line of the lateral connection 14 on each side thereof to the associated rounded concave marginal end portion 22. Thus, the combination of the fold lines or weakened lines 28 in the central web sections 26 together with the associated rounded concave marginal end portions 22 of the sheet material bands 12 allows a user to grip and deflect the central web sections 26 on opposite sides of containers 18 arranged in longitudinal rows along the associated rounded concave marginal end portion 22 and thereby allow gripping of the central web sections 26 across surface areas thereof which are substantially greater than the thickness of the multi-packaging device 10. Further, since the curvature of the rounded concave marginal end portions 22 generally conforms to the user's fingers, no undue discomfort will be experienced by a user in gripping the central web sections 26 along the associated rounded concave marginal end portions 22 and in permitting deflection of such central web sections 26 generally along the fold lines or weakened lines 28 as the container package is lifted and/or transported.

In order to further facilitate gripping of the package in the area of the rounded concave marginal end portion 24, the portions of adjacent sheet material bands 12 in each longitudinal row which are immediately adjacent the rounded concave marginal end portions 24 in the vicinity of the longitudinal connections 16 define side web sections 30 which are opposed to one another in the longitudinal rows. Longitudinal fold lines 32 are formed in the side web sections 30 which traverse the rounded concave marginal end portions 24 and intersect the inner margins of adjacent sheet material bands 12 in the longitudinal rows. When the multi-packaging device 10 is assembled to containers 18, the longitudinal fold lines 32, as the material bands 12 are stretched and enlarged to telescope over containers 18, cause the side web sections 30 to be automatically deflected downwardly as shown in FIG. 2 to present downwardly curving side web sections 30 together with the rounded concave marginal end portions 24 which provide no undue discomfort to the user in lifing and transporting containers 18 assembled together as a group, by the multi-packaging 10 when the side web sections 30 are gripped.

It can, therefore, be seen that the economically and efficiently designed multi-packaging device 10 incorporates novel "bowling grip" styled finger gripping areas which are sufficient to permit lifting and carrying of containers 18 without causing undue discomfort to the user.

Figure 3:
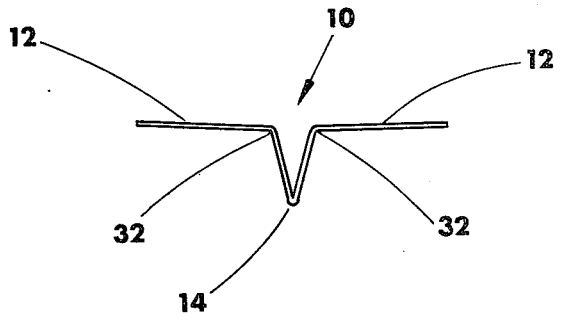
FIG. 3 is a side view of an apertured plastic sheet carrier device shown in FIG. 1, when folded to assume the shape that is depicted.

Reference is now made to FIGS. 3–6 for a description of the novel method of assembling stretchable and elastic plastic sheet multi-packaging devices 10 to containers 18. As can be seen in FIG. 3 of the drawings, the multi-packaging device 10 is folded along the longitudinal centerline fold in the lateral connections 14 between adjacent bands 12 in the longitudinal rows and along the off-center longitudinal lines 32 in the vicinity of the side web sections 30. Thus it can be readily perceived that the multi-packaging device 10 shown in FIGS. 1–2 can have great usefulness in the method of the present invention, although it will also be appreciated that only certain features need be incorporated in the multi-packaging device 10, for the herein disclosed method. These include the sheet material bands 12, regardless of shape or size, the longitudinal centerline fold in the lateral connections 14 between adjacent bands 12 in the longitudinal rows, the longitudinal connections 16 between adjacent bands in the longitudinal fold lines 32, and some form of "bowling grip" design for lifting and transporting the package that is assembled.

In order to fold the multi-packaging device 10 in the form shown in FIG. 3, it is only necessary to bring the off center longitudinal fold lines 32, on opposite sides of the longitudinal centerline fold 14, toward one another to, in turn, cause the longitudinal centerline fold 14 to be positioned downwardly therefrom. As can be seen, the area within the off-center longitudinal fold lines 32 is folded into a downwardly extending V-shaped folded section with the longitudinal centerline fold 14 at the point of the V.

Figure 4:
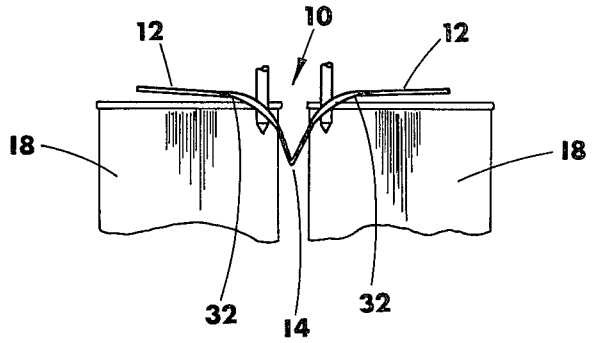
FIG. 4 is a fragmentary side elevational view of the folded apertured plastic sheet carrier device of FIG. 4 in position between two rows of containers.

After the multi-packaging device 10 is folded in the form shown in FIG. 3, the multi-packaging device is then positioned adjacent the upper ends of longitudinal rows of containers 18, as shown in FIG. 4, with the downwardly extending V-shaped folded section between the containers 18 in the longitudinal rows and below the upper rims of the containers 18. As compared with prior art methods, such as my U.S. Pat. No. 3,383,828 where the central portion of a multi-packaging is depressed and continuously held below the upper rims of containers as the material bands are stretched and expanded over corresponding containers, the method of the present invention, due to the off-center longitudinal fold lines 32 and longitudinal centerline fold 14, allows automatic folding into the downwardly V-shaped portion which can be readily positioned between adjacent containers 18 as shown in FIG. 4.

With the multi-packaging device 10 positioned as shown in FIG. 4, the final step in the method involves assembling the multi-packaging device to containers by stretching the sheet material bands 12 and telescoping the remaining portions of the sheet material bands outside of the V-shaped folded section below the upper rims of the containers 18. This is accomplished by substantially simultaneously stretching adjacent sheet material bands 12 on opposite sides of the V-shaped folded section and telescoping the sheet material bands 12 below the upper rims of the containers 18. This step is shown in FIGS. 5 and 6 of the drawings where schematic representations of expanding elements 34 show that the substantially simultaneous stretching and telescoping of adjacent material bands 12 in the longitudinal rows applies uniform stretching and telescoping force to the remaining portions of the sheet material bands outside of the downwardly V-shaped folded section.

Figure 5:
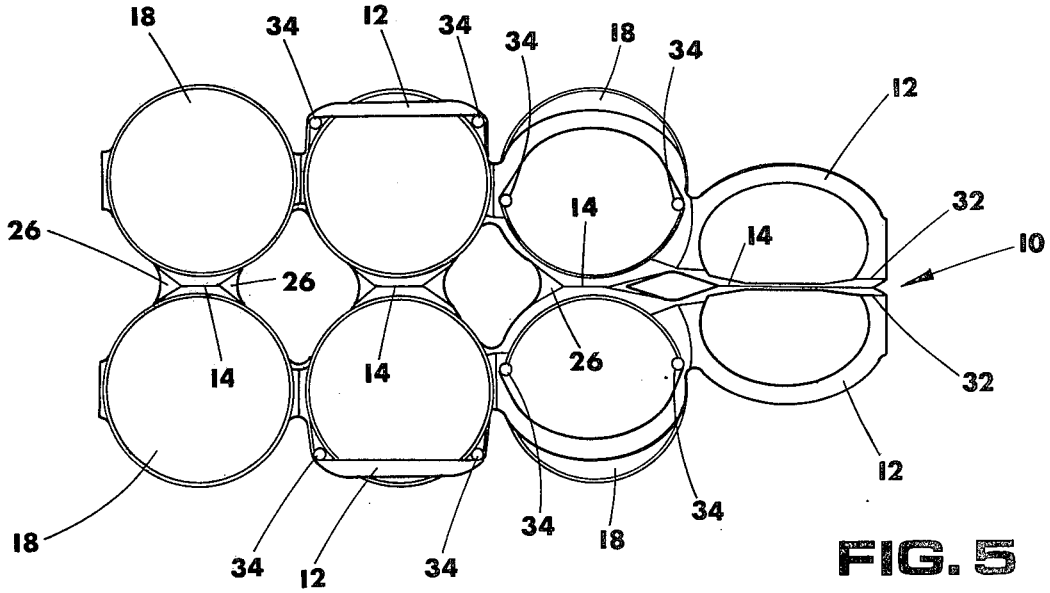
FIG. 5 is a top perspective view illustrating the positioning and the assembly of the folding apertured plastic sheet carrier device to containers.
Figure 6:
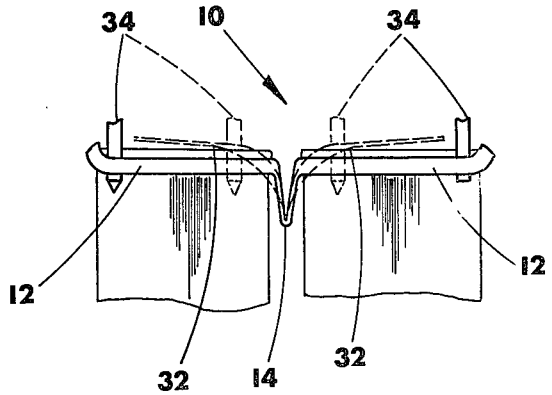
FIG. 6 is a fragmentary side elevational view depicting the assembly step involving stretching and telescoping the apertured plastic sheet carrier device to containers.

It will also be noted in FIG. 5 that with the multi-packaging device 10 folded and positioned between the containers 18, which can take place substantially simultaneously as may be desired, the apertures of the sheet material bands 12, as shown at the right hand side of FIG. 5, present D-shaped configurations which allow outer marginal portions of the sheet material bands 12, outside the folded V-shaped section, to be stretched a greater amount than the inner marginal portions or folded V-shaped sections in order to enable the sheet material bands 12 to more readily conform to the container sidewall below the container rim, whether of cylindrical or "necked-in" design.

From the foregoing, it can thus be seen that the method of the present invention provides simple and efficient procedural steps to assemble plastic multi-packaging devices to containers without the requirements of prior art techniques. Further, it can be seen that the multi-packaging device used in the herein disclosed method can also be used with any of the foregoing assembly techniques as well as the method disclosed herein.

I claim:

1. A stretchable and elastic plastic sheet multi-packaging device for assembly to containers to form a package, said multi-packaging device comprising a plurality of laterally connected pairs of generally ring-shaped sheet material bands arranged in longitudinal rows, adjacent sheet material bands in each longitudinal row being longitudinally connected to one another, the area between the lateral and longitudinal connections of two adjacent pairs of sheet material bands defining a generally diamond-shaped opening with rounded concave marginal end portions of said sheet material bands in the vicinity of the lateral and longitudinal connections, the rounded concave marginal end portions and immediately adjacent portions of said sheet material bands in the vicinity of said lateral connections defining central web sections which are exposed for gripping on opposite sides of adjacent containers arranged in said longitudinal rows when said multi-packaging device is assembled to a corresponding number of containers, each lateral connection being provided with a longitudinal fold-line, and fold lines impressed in said central web sections on opposite sides of the longitudinal fold line in each lateral connection to facilitate deflection thereof and provide gripping by a user on opposite sides of adjacent containers arranged in said longitudinal rows along associated rounded concave marginal end portions of said central web sections and across surface areas of said central web sections which are substantially greater than the thickness of said multi-packaging device.

2. The multi-packaging device as defined in claim 1 wherein the fold lines in the central web sections comprise V-shaped fold lines wherein the V-portion thereof begins in the vicinity of the longitudinal fold line at an area spaced from the associated rounded concave marginal end portion and extends angularly outwardly therefrom on each side of said longitudinal fold line to the associated rounded concave marginal end portion.

3. The multi-packaging device as defined in claim 2 wherein the rounded concave marginal end portions and immediately adjacent portions of said sheet material bands in the vicinity of said longitudinal connections in said longitudinal rows define opposed side web sections, and fold lines formed in said side web sections to facilitate deflection thereof when said multi-packaging device is assembled to container.

4. The multi-packaging device as defined in claim 3, wherein the fold lines in said side web sections comprise longitudinally extending fold lines which traverse the rounded concave marginal end portions and intersect the inner margins of said sheet material bands.

5. The method of assembling a stretchable and elastic plastic sheet multi-packaging device having a plurality of laterally connected pairs of generally ring-like shaped sheet material bands arranged in longitudinal rows with adjacent bands in each row being longitudinally connected to one another, comprising the steps of forming a longitudinal centerline fold in each of said lateral connections and a pair of off-center longitudinal fold lines on each side of said longitudinal centerline fold across said sheet material bands and in the vicinity of the longitudinal connections, folding said multi-packaging device along said aforementioned fold lines to form a downwardly extending V-shaped folded section of said sheet material bands within the off-center longitudinal fold lines, positioning the multi-packaging device adjacent the upper ends of longitudinal rows of containers with the downwardly extending V-shaped folded section between containers in said longitudinal rows and below the upper rim of said containers, and assembling the multi-packaging device to containers by stretching the elastic sheet material bands and telescoping the remaining portions of said sheet material bands outside of said V-shaped folded section below the upper rims of said containers.

6. The method as defined in claim 5 wherein the aforementioned fold lines are impressed in said sheet material bands substantially simultaneously with the forming of said sheet material bands.

7. The method as defined in claim 6 wherein the longitudinal centerline fold is folded in an opposite direction to the off-center longitudinal fold lines.

8. The method as defined in claim 5 wherein the folding and positioning steps take place substantially at the same time.

9. The method as defined in claim 5 comprising the step of substantially simultaneously stretching adjacent sheet material bands in said longitudinal rows on opposite sides of said V-shaped folded section.

10. The method as defined in claim 5 wherein the sheet material band portions outside of the off-center longitudinal fold lines are folded to extend across the tops of said containers at an angle substantially normal to said V-shaped folded section.

11. The method of assembling a stretchable and elastic plastic sheet multi-packaging device to a corresponding number of containers to form a package, said multi-packaging device being formed with at least two parallel rows of elastic bands that are joined to each other between said parallel rows by a central web section and are joined to each other in each parallel row by side web sections, the central web sections being formed with a longitudinal centerline fold and the side web sections being formed in the vicinity thereof with a longitudinal fold line parallel to said longitudinal centerline fold, comprising the steps of positioning the multi-packaging device adjacent the upper ends of a corresponding number of containers arranged in two parallel rows with the area of said sheet material bands within the side web section longitudinal fold lines being located between the container and below the upper margins thereof, and expanding the sheet material bands while telescoping same below the upper margins of said containers.

* * * * *